US006019648A

United States Patent [19]

Lecours et al.

[11] Patent Number: 6,019,648

[45] Date of Patent: Feb. 1, 2000

[54] NOISE REDUCING SYSTEM

[75] Inventors: Gaétan Lecours; Louis Lefebvre, both of Valcourt; Rémy Oddo, Québec, all of Canada

[73] Assignee: Bombardier Inc., Montreal, Canada

[21] Appl. No.: 09/020,170

[22] Filed: Feb. 6, 1998

[30] Foreign Application Priority Data

Feb. 4, 1998 [CA] Canada ..... 2228759

[51] Int. Cl.[7] ..... B63H 11/00

[52] U.S. Cl. ..... 440/38; 440/89

[58] Field of Search ..... 440/52, 38, 39, 440/46, 47, 89, 111, 113, 112

[56] References Cited

U.S. PATENT DOCUMENTS 4,629,432 12/1986 Dyrkorn et al. ..... 440/52

5,310,368 5/1994 Kamitake ..... 440/38

5,460,553 10/1995 Craig et al. ..... 440/38

*Primary Examiner*—Stephen Avila

*Attorney, Agent, or Firm*—St. Onge Steward Johnston & Reens LLC

[57] ABSTRACT

A noise reducing system for a personal watercraft. The system includes a pump insulating system which insulates the pump housing from the hull. More particularly, the pump insulating system includes at least one insulating attachment for connecting a pump housing to a supporting surface of a personal watercraft. Such insulating attachment includes an insulator having a portion mounted between the pump housing and the supporting surface. Advantageously, the system also includes a resonator and a shield, both mounted on the exhaust system, and an insulating material mounted inside an air intake pipe.

20 Claims, 9 Drawing Sheets

NOISE REDUCING SYSTEM

FIELD OF THE INVENTION

The invention relates to a noise reducing system for personal watercraft.

BACKGROUND OF THE INVENTION

A personal watercraft is a new recreational vehicle which has had a resounding commercial success during the last several years. However, personal watercraft suffer from complaints of noise pollution.

Several countries, such as the United States and France are studying the possibility of passing regulations which will limit the noise of a personal watercraft to 80 DB(A) at a distance of 7.5 m. Prior art personal watercrafts usually emit more than this level. Thus, there is a need in the industry to provide a personal watercraft which emits a more tolerable level of DB(A).

Studies have showed that personal watercraft noise problems are complex because the noise comes from multiple sources and follow multiple transfer paths. Indeed, sources may be divided into three categories (i) structural noise which is related to the hull radiating noise coming from induced efforts created by the jet pump and other mechanical elements fixed to the structure (mechanical excitation); (ii) aerial noise which corresponds to the noise emitted by acoustical wave transmission produced by the muffler walls and the air intake (acoustical excitation); and (iii) direct noise such as muffler outlet or jet pump flow.

It has been shown that insulating the pump from the hull will reduce the noise coming from the pump itself and from the motor via the shaft (mechanical excitation). If has also been shown that it is possible to reduce the acoustical excitation by insulating some noise generating components.

An object of the present invention is to provide a noise reducing system which reduces the noise generated by a personal watercraft.

A further object of the invention is to provide a pump insulating system which reduces structural noise coming from the pump, and from the motor via the shaft, without substantially decreasing the performance of the pump.

As embodied and broadly described herein, the invention seeks to provide a pump insulating system for a personal watercraft having a pump housing and a rear supporting wall, said insulating system including at least one insulating attachment for connecting said pump housing to said rear supporting wall, said insulating attachment including at least one T-shaped insulator having a longitudinal aperture and a portion mounted between said pump housing and said rear supporting wall, a sleeve within the longitudinal aperture of said insulator, and a threaded rod extending through said sleeve for retaining said pump housing to said rear supporting wall.

The invention further seeks to provide a personal watercraft including a hull having an internal duct leading from a water inlet portion to a rearward outlet and a rear supporting wall, an engine mounted in said hull, a shaft extending rearwardly from the engine toward an impeller, said impeller is rotatably journaled in a pump housing, said pump housing is attached to said rear supporting wall, wherein the improvement includes a pump insulating system comprising at least one insulating attachment for connecting said pump housing to said rear supporting wall, said insulating attachment including an insulator having a portion mounted between said pump housing and said rear supporting wall.

In a preferred embodiment of the present invention the novel noise reducing system for use on a personal watercraft comprises: an air intake tube having an insulating foam inside; a pump insulating system having at least one insulating attachment; said insulating attachment comprising a threaded rod, a sleeve having an aperture in which the threaded rod is inserted and at least one T-shaped rubber insulator; a muffler including a shield mounted thereon; the shield having a first polyurethane foam layer and a second composite layer; and a resonator made of moulded plastic mounted on an exhaust pipe.

Other objects and features of the invention will become apparent by reference to the following specification and to the drawings.

BRIEF DESCRIPTION OF THE DRANINGS

A detailed description of the preferred embodiment of the invention is provided herein with reference to the following drawings, wherein.

Figure 1:
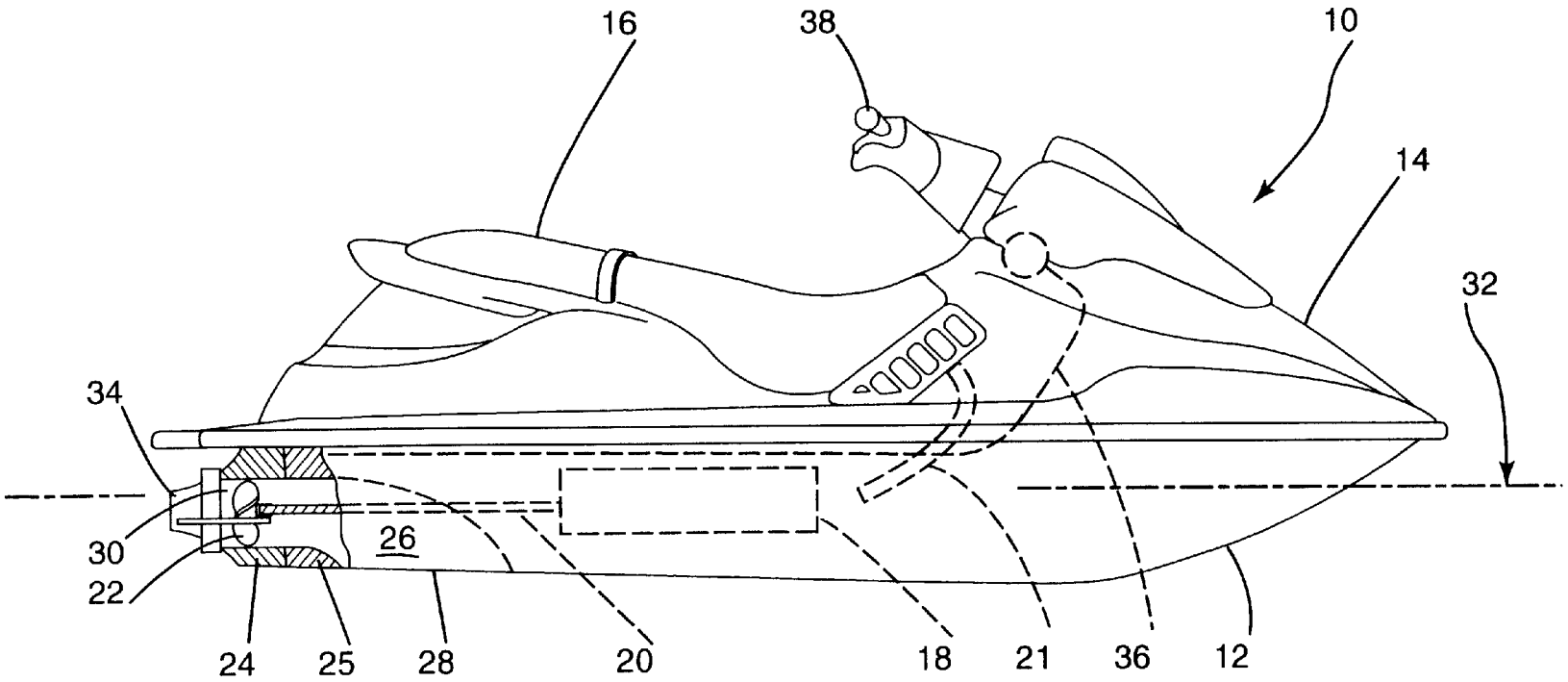
FIG. 1 is a side elevational view of a watercraft.

In the drawings, the preferred embodiment of the invention is illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENTS

Referring now to the drawings, FIG. 1 illustrates a personal watercraft 10 comprising a hull 12 and a superstructure that includes a forward cab portion 14 and a rear seat portion 16 to support a driver and/or passenger.

The propulsion system of the watercraft 10 comprises an engine schematically represented at 18 having a shaft 20 driving a pump 22. An air intake tube 21 is supplied for providing to the engine enough air for its operation and for allowing an air flow which eliminates fuel vapour. The pump 22 is located within a pump housing 24 that is affixed to a supporting surface 25 of a wall located at the end of the hull 12. The hull 12 has an internal duct 26 leading from a forward inlet 28 to a rearward outlet 30. The inlet 28 is positioned in the keel region of the hull 12 and is thus at all times below the waterline represented at 32.

The steering of the watercraft 10 is effected by means of an outlet nozzle 34 which is mounted to be pivotable about a generally vertical axis under the control of a linkage 36 that is connected to a handlebar 38. The pump 22 drives a jet of water through the duct 26 and rearwardly through the outlet nozzle 34 for the propulsion of the watercraft 10.

Figure 2:
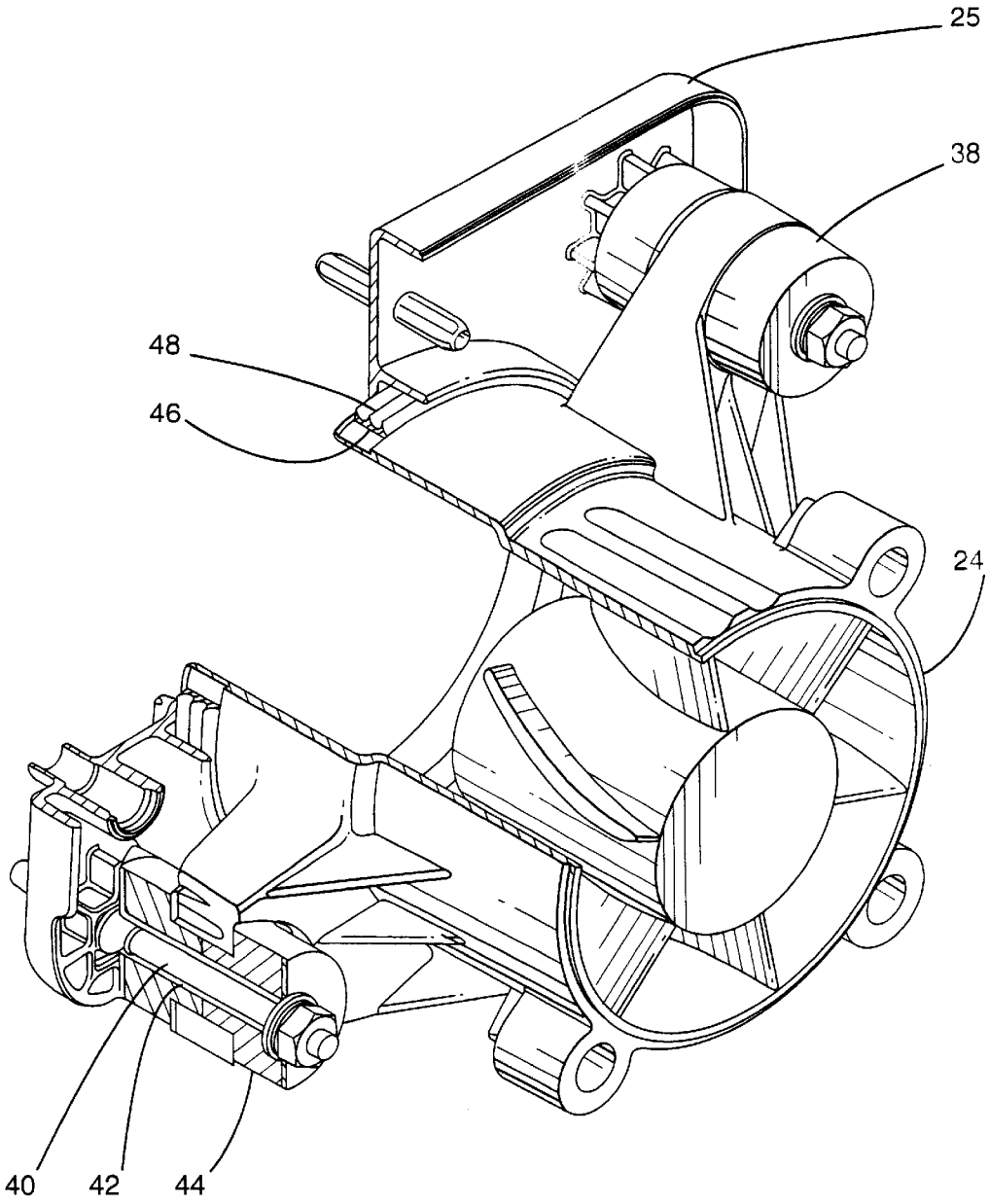
FIG. 2 is an enlarged fragmentary perspective view of a pump housing wherein one insulating attachment used in the invention is shown with a sectional view taken along a mid line.

As illustrated in FIG. 2, the pump housing 24 is affixed to the supporting surface 25 with at least one pump insulating attachment 38. The insulating attachment 38 includes a threaded rod 40, a sleeve 42 having an aperture in which the threaded rod 40 is inserted and at least one T-shaped rubber insulator 44. The threaded rod 40 and the rubber insulator 44 are adapted to allow compression of about 5% to 30%.

Figure 3:
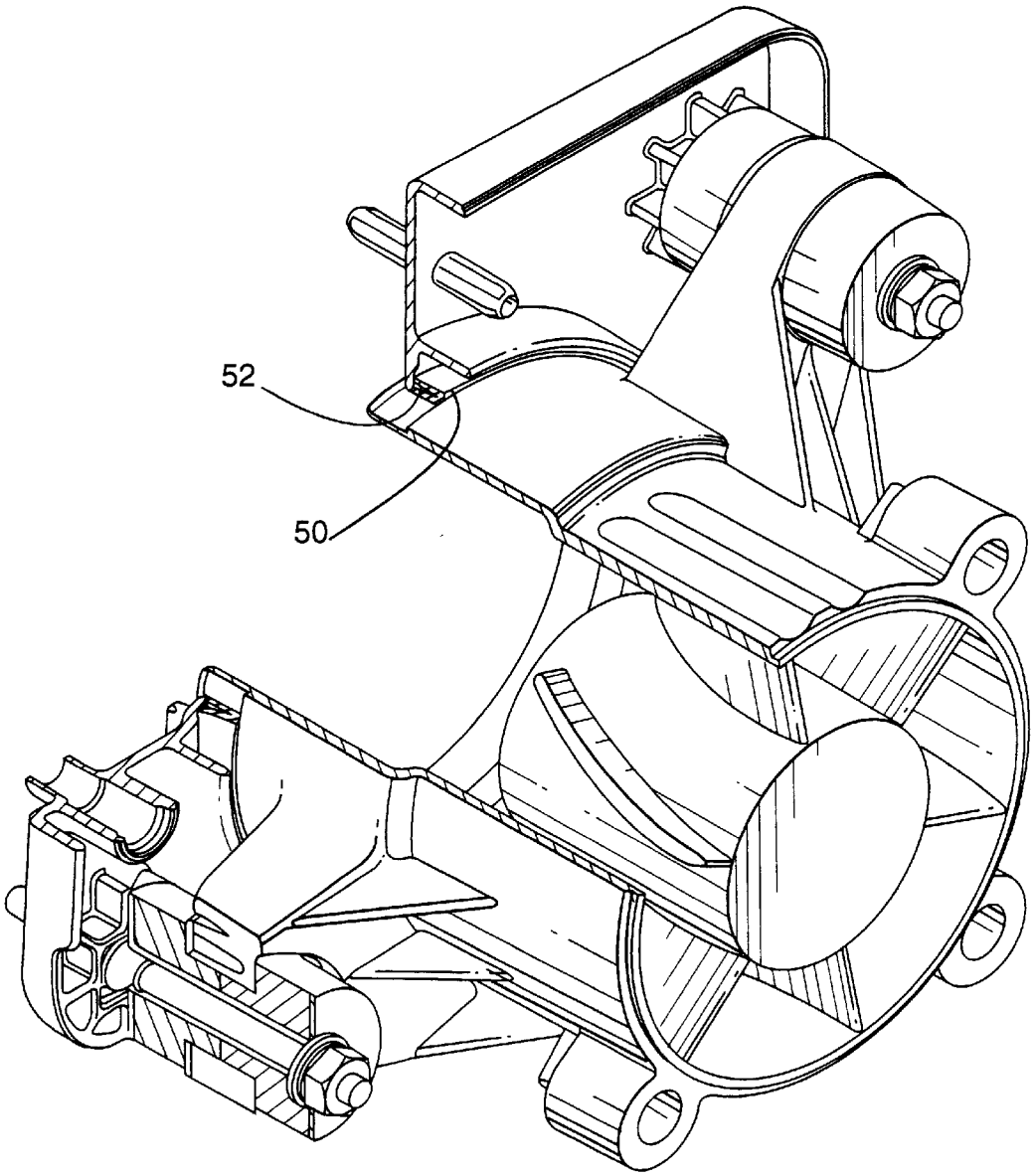
FIG. 3 is similar to FIG. 2 except that a different circular sealing gasket is illustrated.

A circular sealing gasket 46 is mounted between the pump housing 24 and the supporting surface 25 in order to avoid any pressure loss at their junction. The circular sealing gasket 46 has at least one projection 48. As illustrated in FIG. 3, a circular sealing gasket 50, instead of the circular sealing gasket 46, is mounted between the pump housing 24 and the supporting surface 25. The sealing gasket 50 has a groove 52 for defining a V shape and for increasing its flexibility. When the pressure increases in the internal duct 26, the sealing gasket 50 then permits a higher sealing action.

Figure 4:
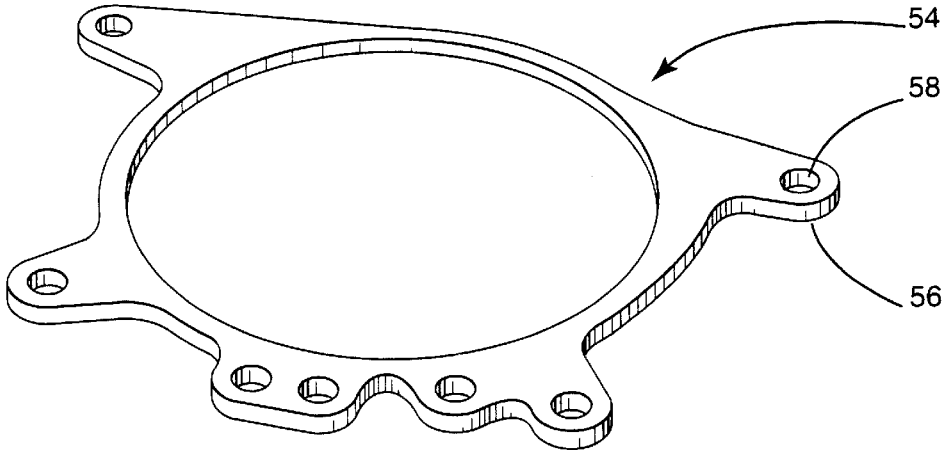
FIG. 4 is an enlarged perspective view of a sealing gasket having projections for insulating the attachment points.

As illustrated in FIG. 4, instead of a circular sealing gasket, a sealing gasket 54 having at least one projection 56 may be provided for installation between the pump housing 24 and the supporting surface 25. The projection 56 has an aperture 58 allowing insertion of a pump attachment and a certain degree of flexibility. Thus, the sealing gasket 54 reduces structural noise coming from the pump 22 and seals the pump housing.

Figure 6:
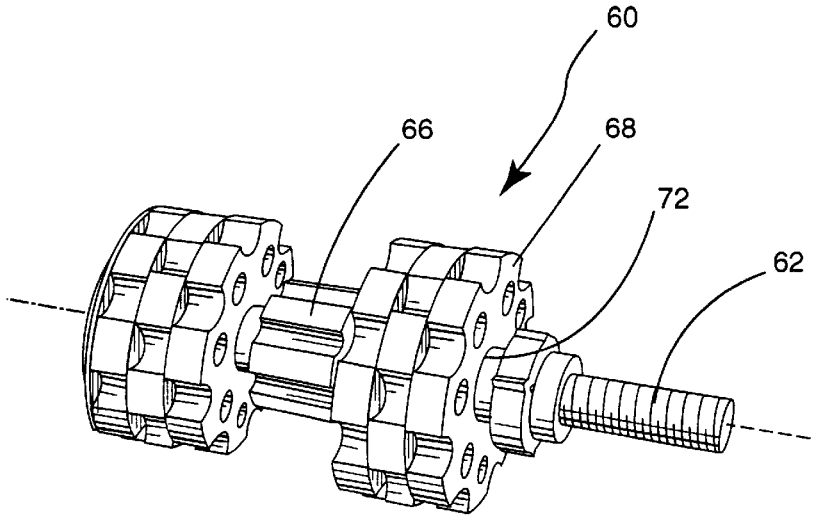
FIG. 6 is an enlarged perspective view of the insulating attachment constructed in accordance with a first variant.
Figure 5:
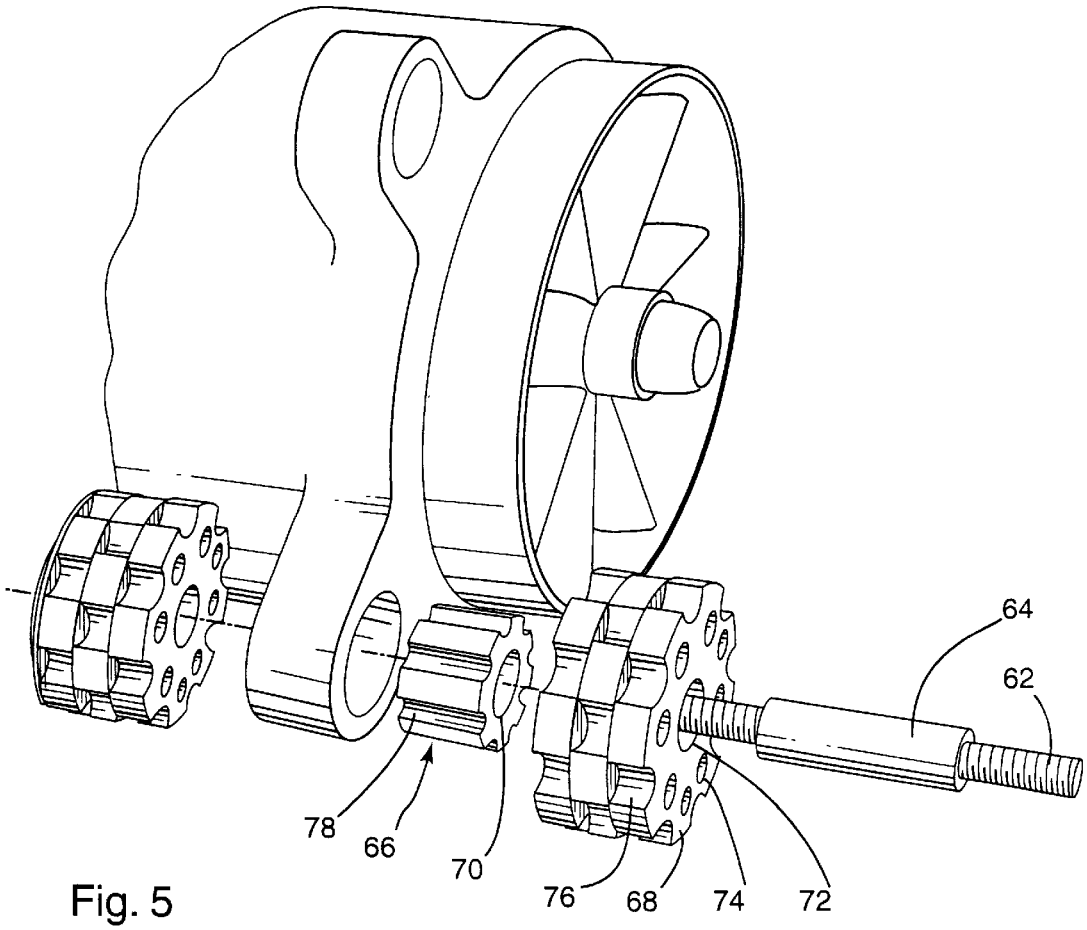
FIG. 5 is an enlarged perspective view of a pump housing showing an exploded view of an insulating attachment constructed in accordance with a first variant.

Referring now to FIG. 5, a pump insulating attachment constructed in accordance with a first variant is represented at 60. The insulating attachment 60 includes a threaded rod 62, a sleeve 64 having an aperture in which the threaded rod 62 is inserted, at least one inside insulator 66 and at least one outside insulator 68. The inside insulator 66 and the outside insulator 68 have an aperture 70 and 72 respectively for allowing insertion of the sleeve 64. The outside insulator 68 has also at least one aperture 74 and a crenellated surface 76 for increasing its flexibility. The inside insulator 66 has also a crenellated surface 78. FIG. 6 illustrates the insulating attachment 60 wherein the insulators 66 and 68 are mounted on the threaded rod 62.

Figure 7:
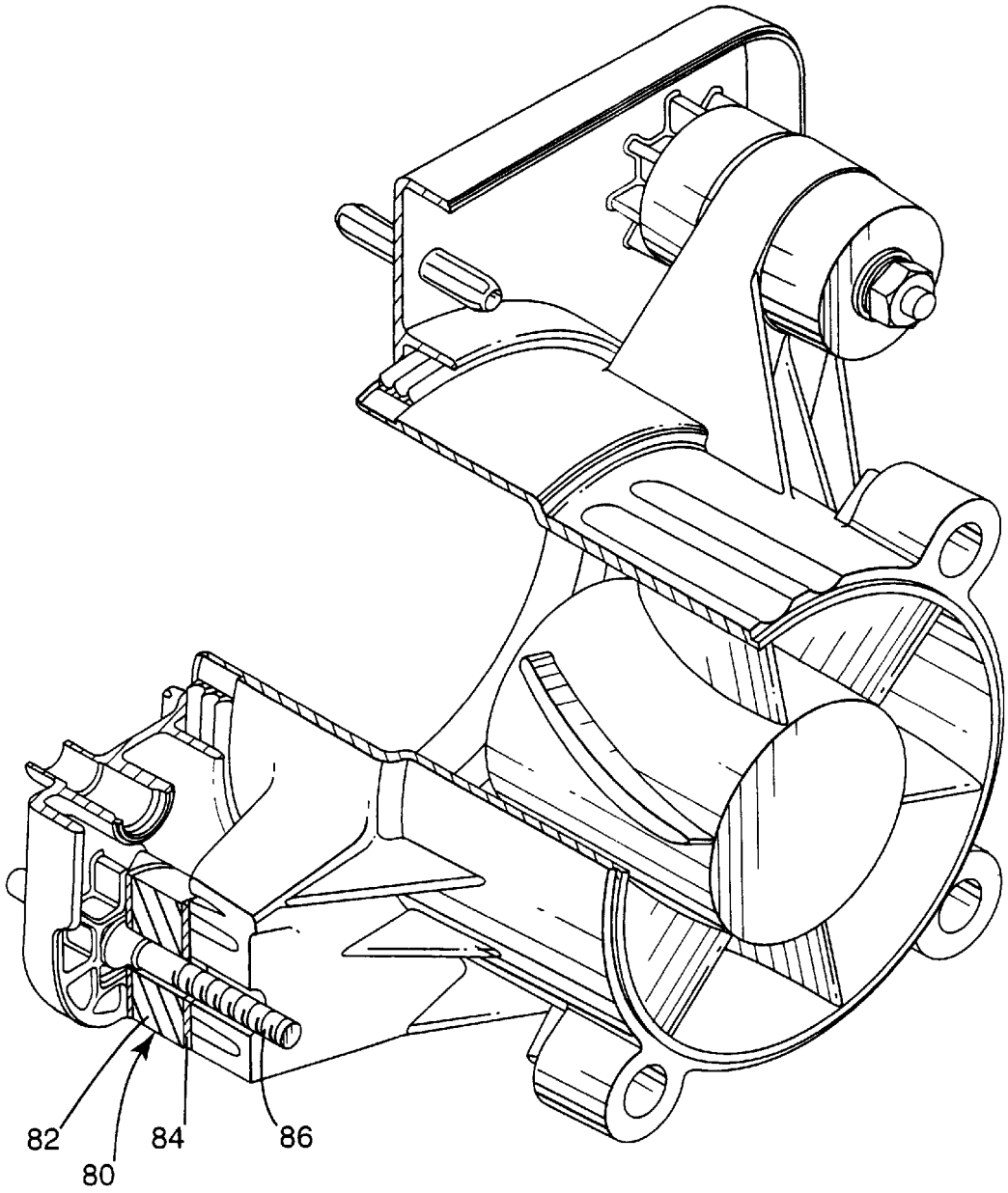
FIG. 7 is an enlarged fragmentary perspective view of a pump housing wherein one insulating attachment constructed with a second variant is shown with a sectional view taken along a mid line.

FIG. 7 illustrates an insulating attachment 80 constructed in accordance with a second variant. The insulating attachment 80 includes an insulator 82 mounted between two supporting plates 84 having a threaded rod 86 affixed thereon.

Figure 8:
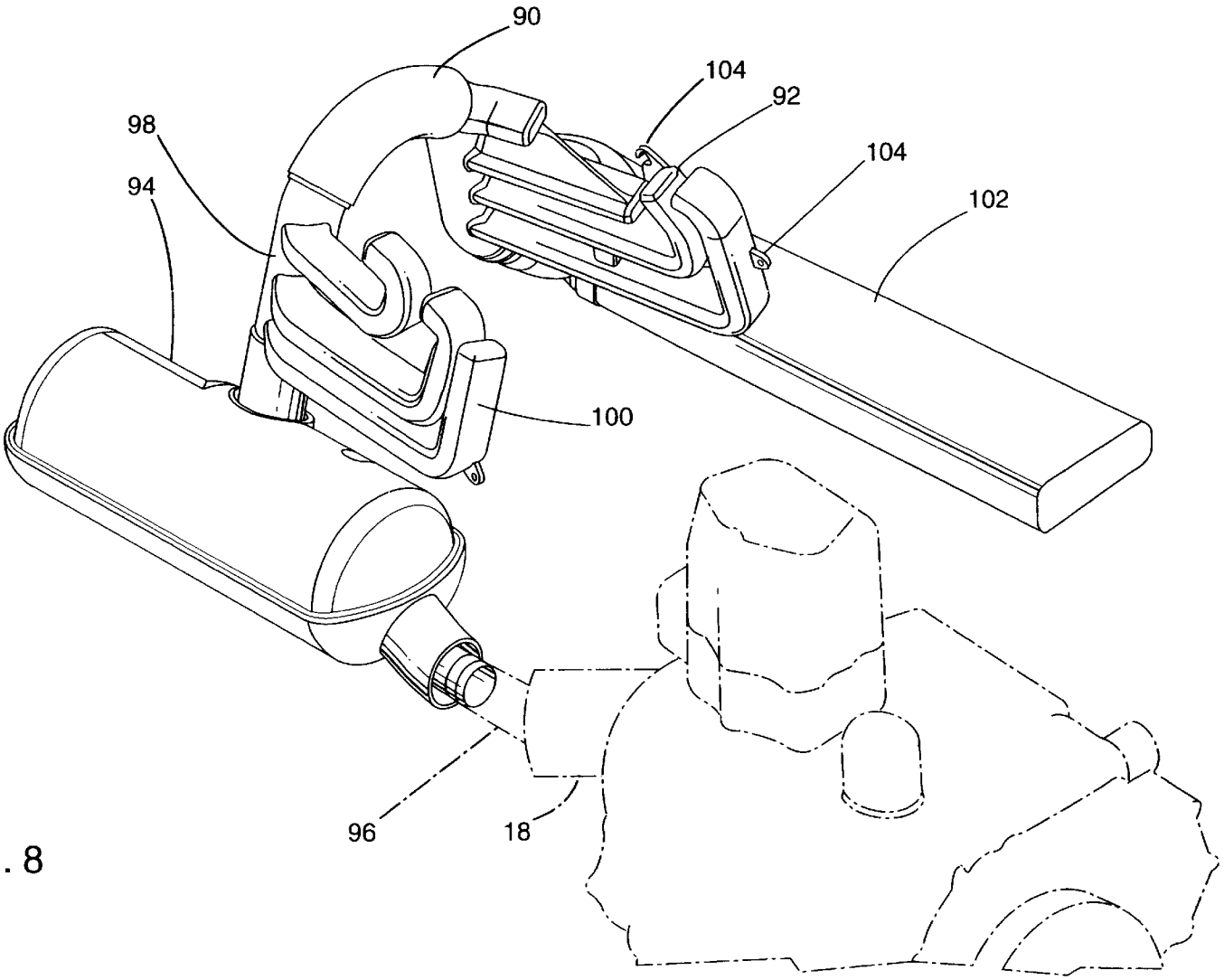
FIG. 8 is an enlarged perspective view of an exhaust pipe including a muffler shield and a resonator used in the invention.
Figure 9:
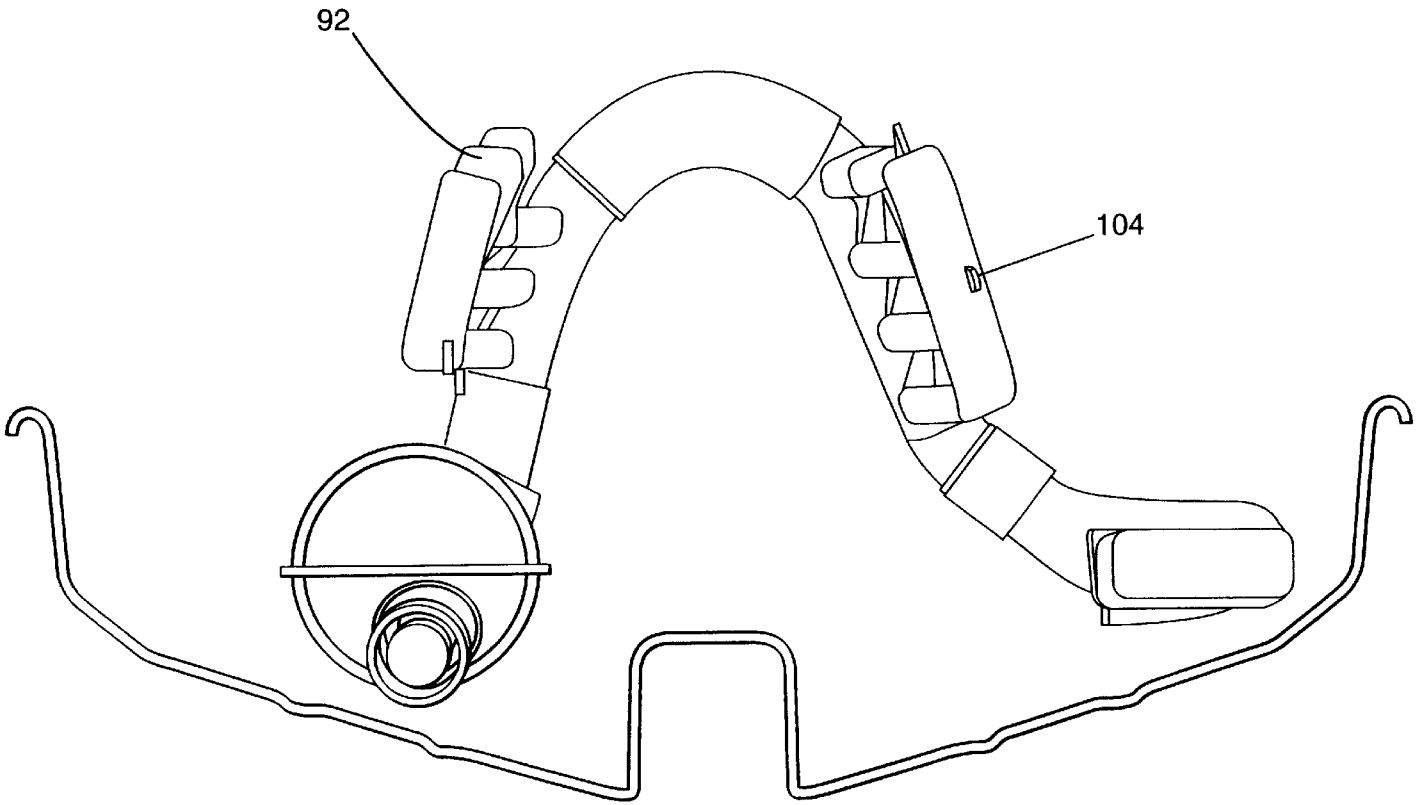
FIG. 9 is an enlarged elevational view of the exhaust pipe illustrated in FIG. 8.

Referring now to FIGS. 8 and 9, an exhaust line 90 includes at least one resonator 92, a muffler 94 and a tuned pipe 96 (schematically represented) located between the muffler 94 and the engine 18 (also schematically represented). The resonator 92 is made of moulded plastic and comprises a main-pipe 98 with at least one frequency pipe 100 mounted thereon. At the outlet, the exhaust line 90 comprises a larger resonator 102. Because the resonator 92 is mounted perpendicularly to the exhaust line 90, the resonator 92 does not affect the performance of the engine 18. Indeed, the back pressure and the exhaust flow are not influenced by the resonator 92. The exhaust line 90 comprises attachment means 104 for affixing it to the hull 12. It is understood that the resonator 92 may have different configurations for attenuating some undesirable sound frequencies. For example, the number and the length of the frequency pipe(s) 100 may vary in order to obtain different results.

It is understood that it may be possible to use one of the sealing gasket described above in combination with one of the pump insulating attachment also described above by doing the necessary modifications if required.

Figure 11:
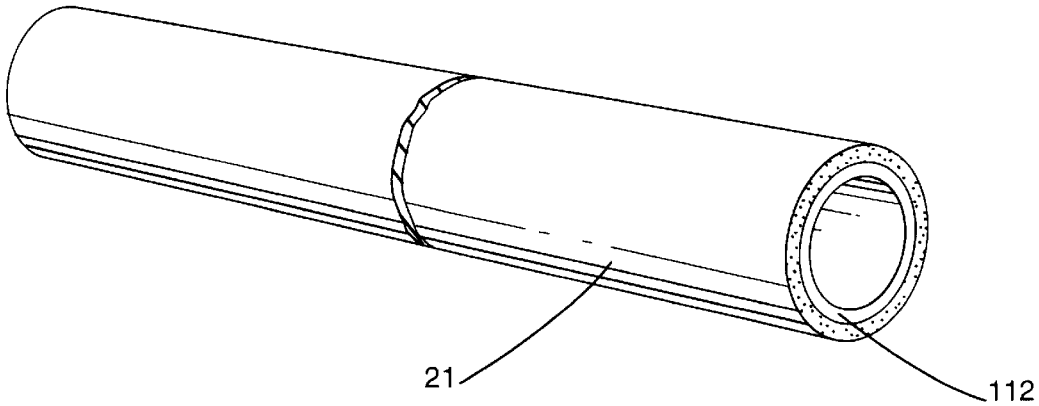
FIG. 11 is an enlarged fragmented perspective view of an air intake tube.
Figure 10:
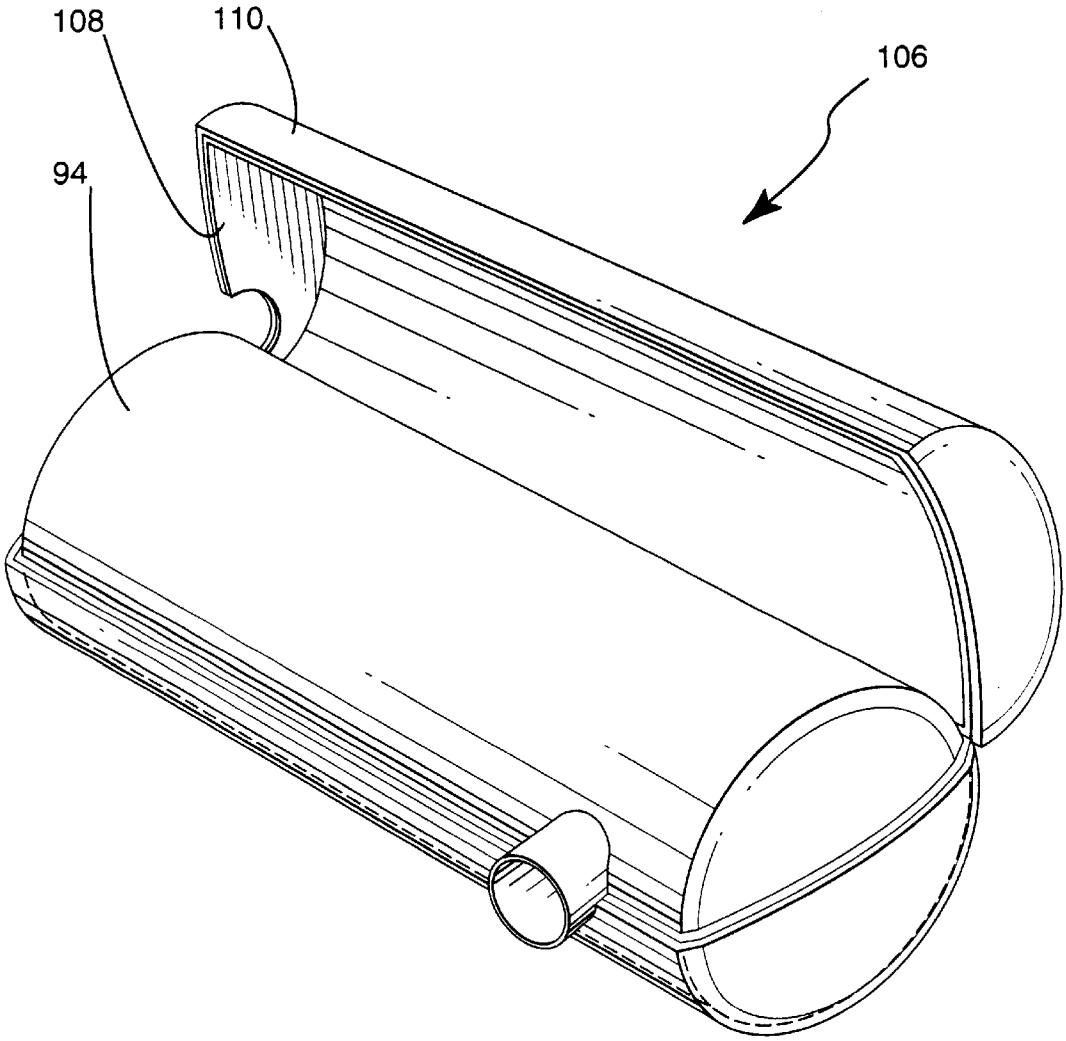
FIG. 10 is an enlarged perspective view of the muffler shield shown in FIGS. 8 and 9 wherein half of the muffler shield is illustrated.

FIG. 10 illustrates the muffler 94 wherein it is possible to see that it is recovered with a shield 106 comprising a first polyurethane foam layer 108 and a second composite layer 110. More particularly the foam layer 108 is made of a foam conforming to the standard number ASTM D 3574-86 and the composite layer 110 is made of a material sold under the trades marks BARYMAT BM-1A or BARYMAT BM-1C. FIG. 11 illustrates the air intake tube 21 having an insulating foam layer 112 mounted inside, the insulating foam layer 112 is also made of a foam conforming to the standard number ASTM D 3574-86.

The above description of the preferred embodiment should not be interpreted in any limiting manner since variations and refinements are possible which are within the spirit and scope of the present invention. The scope of the invention is defined in the appended claims.

We claim:

1. A pump insulating system for a personal watercraft having a pump housing and a rear supporting wall, said insulating system including at least one insulating attachment for connecting said pump housing to said rear supporting wall, said insulating attachment including:

a) at least one T-shaped insulator having a longitudinal aperture and a portion mounted between said pump housing and said rear supporting wall;

b) a sleeve within the longitudinal aperture of said insulator; and c) a threaded rod extending through said sleeve for retaining said pump housing to said rear supporting wall.

2. The insulating system as defined in claim 1, wherein said insulating attachment comprises a threaded rod; and a sleeve having an aperture in which said threaded rod is inserted; wherein said insulator includes an inside insulator and at least one outside insulator.

3. The insulating system as defined in claim 1, wherein said insulator is rubber.

4. The insulating system as defined in claim 1, wherein said insulator permits a compression of about 5% to 30%.

5. The insulating system as defined in claim 1, wherein said insulating system further comprises a sealing gasket mounted between the pump housing and the supporting surface.

6. A personal watercraft including a hull having an internal duct leading from a water inlet portion to a rearward outlet and a rear supporting wall, an engine mounted in said hull, a shaft extending rearwardly from the engine toward an impeller, said impeller is rotatably journaled in a pump housing, said pump housing is attached to said rear supporting wall, wherein the improvement includes a pump insulating system comprising at least one insulating attachment for connecting said pump housing to said rear supporting wall, said insulating attachment including an insulator having a portion mounted between said pump housing and said rear supporting wall.

7. The personal watercraft as defined in claim 6, wherein said insulating attachment comprises a threaded rod; and a sleeve having an aperture in which said threaded rod is inserted; and wherein said insulator includes an inside insulator and at least one outside insulator.

8. The personal watercraft as defined in claim 6, wherein said insulator is rubber.

9. The personal watercraft as defined in claim 6, wherein said insulator permits compression of 5% to 30%.

10. The personal watercraft as defined in claim 6, wherein said insulating system further comprises a sealing gasket being mounted between the pump housing and the supporting surface.

11. The personal watercraft as defined in claim 6, wherein said insulating attachment includes at least one T-shaped insulator having a longitudinal aperture and a portion mounted between said pump housing and said rear supporting wall, a sleeve within the longitudinal aperture of said insulator, and a threaded rod extending through said sleeve for retaining said pump housing to said rear supporting wall.

12. A personal watercraft including:

a motor;

an exhaust system with one end mounted on an exhaust gas outlet of the motor and having an exhaust pipe and a muffler;

a pump;

a shaft connected between the motor and the pump;

a hull structure with a tunnel and an air intake;

an air intake tube connected between the air intake and the pump;

a supporting surface of a wall located at one end of the hull structure;

a pump housing attached to the supporting surface; wherein the improvement includes:

a resonator mounted on the exhaust pipe for attenuating undesirable frequencies;

said watercraft further including a pump insulating system comprising at least one insulating attachment for connecting the pump housing to the supporting surface; said insulating attachment including an insulator having a portion mounted between the pump housing and the supporting surface;

an insulating shield mounted on the muffler; and an insulating material mounted inside the air intake tube.

13. The personal watercraft as defined in claim 12, wherein said insulating attachment comprises a threaded rod and a sleeve having an aperture in which said threaded rod is inserted; and wherein said insulator includes at least one T-shaped insulator.

14. The personal watercraft as defined in claim 12, wherein said insulating attachment comprises a threaded rod, and a sleeve having an aperture in which said threaded rod is inserted; and wherein said insulator includes an inside insulator and at least one outside insulator.

15. The personal watercraft as defined in claim 12, wherein said insulator is rubber.

16. The personal watercraft as defined in claim 12, wherein said insulator permits compression of 5% to 30%.

17. The personal watercraft as defined in claim 12, wherein said insulating system further comprises a sealing gasket mounted between the pump housing and the supporting surface.

18. The personal watercraft as defined in claim 12, wherein said resonator includes a main pipe mounted on the exhaust pipe and at least one frequency pipe mounted thereon, and wherein said resonator is moulded plastic.

19. The personal watercraft as defined in claim 12, wherein said insulating shield comprises a first layer made of foam and a second layer made of composite material.

20. The personal watercraft as defined in claim 12, wherein said insulating material is foam.

* * * * *